US009517869B2

(12) United States Patent
Ammann

(10) Patent No.: US 9,517,869 B2
(45) Date of Patent: Dec. 13, 2016

(54) METHOD FOR DETACHING OR SEPARATING A SEALING FILM OR FOIL SEALINGLY ATTACHED TO THE RIM OF THE NECK OF A BOTTLE, OR THE LIKE, AND A SCREW CAP FOR IMPLEMENTATION OF SAID METHOD

(76) Inventor: Rainer Ammann, Bobingen (DE)

( * ) Notice: Subject to any disclaimer, the term of this patent is extended or adjusted under 35 U.S.C. 154(b) by 1374 days.

(21) Appl. No.: 13/046,013

(22) Filed: Mar. 11, 2011

(65) Prior Publication Data

US 2011/0155687 A1 Jun. 30, 2011

Related U.S. Application Data

(62) Division of application No. 11/571,401, filed as application No. PCT/EP2005/007056 on Jun. 30, 2005, now abandoned.

(30) Foreign Application Priority Data

Jul. 1, 2004 (DE) ..... 10 2004 032 100

(51) Int. Cl.
*B65D 51/22* (2006.01)

(52) U.S. Cl.
CPC ..... *B65D 51/228* (2013.01); *B65D 2251/0015* (2013.01); *B65D 2251/0093* (2013.01)

(58) Field of Classification Search
CPC ..... B65D 51/228; B65D 2251/0093
USPC ..... 215/250, 252, 257, 297, 301, 341, 343, 215/349–351; 220/254.1, 254.8, 254.9, 220/258.1, 258.3–258.5, 267, 277, 278; 222/81, 83, 85
See application file for complete search history.

(56) References Cited

U.S. PATENT DOCUMENTS

| | | | | | |
|---|---|---|---|---|---|
| 1,664,047 | A | * | 3/1928 | Sacerdote | 215/226 |
| 2,026,889 | A | * | 1/1936 | Gray et al. | 215/337 |
| 2,066,390 | A | * | 1/1937 | Cahoon et al. | 215/253 |
| 3,071,276 | A | * | 1/1963 | Pellett et al. | 215/261 |
| 3,402,855 | A | * | 9/1968 | Schroeder et al. | 222/83 |
| 3,612,325 | A | * | 10/1971 | Williams | 215/329 |
| 4,325,487 | A | * | 4/1982 | Libit | B65D 41/0471 215/330 |
| 4,473,163 | A | | 9/1984 | Geiger | |
| 4,555,037 | A | | 11/1985 | Rhees | |
| 4,721,215 | A | | 1/1988 | Bertaud et al. | |
| 4,754,889 | A | * | 7/1988 | Debetencourt | 215/232 |
| 4,767,016 | A | | 8/1988 | Cook, Jr. et al. | |
| 4,792,053 | A | * | 12/1988 | Towns | B65D 55/066 215/250 |
| 4,793,504 | A | * | 12/1988 | Towns et al. | 215/250 |

(Continued)

FOREIGN PATENT DOCUMENTS

| | | | |
|---|---|---|---|
| DE | 69302432 | T | 12/1996 |
| EP | 0421821 | A | 4/1991 |

(Continued)

*Primary Examiner* — Anthony Stashick
*Assistant Examiner* — Raven Collins
(74) *Attorney, Agent, or Firm* — Brooks Kushman P.C.

(57) ABSTRACT

A screw cap for separation of a sealing film or foil that is sealingly attached to a rim of a neck of a container as the cap is removed from the container. The screw cap has a complementary thread to the thread on the neck of the container for installation of the cap on the neck. The screw cap can be unscrewed at any later point in time. When the screw cap is unscrewed from the neck, the cap includes a knife with an edge positioned to separate the sealing film from the rim 11 of the neck 3 by radially starting from the periphery of the rim and progressing inwardly.

28 Claims, 14 Drawing Sheets

(56) References Cited

U.S. PATENT DOCUMENTS

| | | | | | |
|---|---|---|---|---|---|
| 4,793,505 | A | * | 12/1988 | Towns et al. | 215/250 |
| 4,884,705 | A | * | 12/1989 | Debetencourt | 215/250 |
| 5,007,546 | A | | 4/1991 | Rose et al. | |
| 5,090,581 | A | * | 2/1992 | Rose et al. | 215/48 |
| 5,176,271 | A | | 1/1993 | Panchaud et al. | |
| 5,255,813 | A | * | 10/1993 | Berggren et al. | 220/278 |
| 5,609,263 | A | * | 3/1997 | Perchepied | 215/252 |
| 5,615,789 | A | | 4/1997 | Finkelstein et al. | |
| 5,927,532 | A | | 7/1999 | Traub | |
| 6,089,391 | A | * | 7/2000 | Abelbeck et al. | 215/303 |
| 6,571,994 | B1 | * | 6/2003 | Adams et al. | 222/521 |
| 6,874,648 | B2 | * | 4/2005 | Willingham et al. | 215/344 |
| 7,083,058 | B2 | * | 8/2006 | Perry et al. | 215/228 |
| 7,207,465 | B2 | * | 4/2007 | Weist | 222/83 |
| 7,261,226 | B2 | * | 8/2007 | Adams et al. | 222/521 |
| 8,381,924 | B2 | * | 2/2013 | Parrinello et al. | 215/48 |
| 2002/0144971 | A1 | * | 10/2002 | Nilstoft et al. | 215/350 |
| 2003/0057175 | A1 | * | 3/2003 | Willingham et al. | 215/344 |
| 2004/0026422 | A1 | * | 2/2004 | Westphal | 220/277 |
| 2004/0065977 | A1 | * | 4/2004 | Bron et al. | 264/268 |
| 2005/0098529 | A1 | | 5/2005 | Bloom et al. | |
| 2005/0173436 | A1 | * | 8/2005 | Amanat et al. | 220/258.4 |
| 2005/0242113 | A1 | * | 11/2005 | Weist | 222/83.5 |
| 2006/0071000 | A1 | * | 4/2006 | Weist et al. | 220/278 |
| 2006/0151421 | A1 | * | 7/2006 | Rho | 215/297 |
| 2007/0095782 | A1 | * | 5/2007 | Granger et al. | 215/351 |
| 2009/0026165 | A1 | * | 1/2009 | Ammann | 215/257 |

FOREIGN PATENT DOCUMENTS

| | | | | |
|---|---|---|---|---|
| EP | 421821 | A1 | * | 4/1991 |
| EP | 0530677 | A1 | | 10/2003 |
| FR | 2730703 | | | 3/2007 |
| GB | 2080775 | A | * | 2/1982 |

* cited by examiner

METHOD FOR DETACHING OR SEPARATING A SEALING FILM OR FOIL SEALINGLY ATTACHED TO THE RIM OF THE NECK OF A BOTTLE, OR THE LIKE, AND A SCREW CAP FOR IMPLEMENTATION OF SAID METHOD

CROSS-REFERENCE TO RELATED APPLICATIONS

This application is a division of U.S. application Ser. No. 11/571,401 filed Dec. 28, 2006, now abandoned, which, in turn, claims the benefit of application Serial No. PCT/EP2005/007056 Jun. 30, 2005, which claims priority to foreign application DE 10 2004 032 100.0, filed Jul. 1, 2004.

BACKGROUND

The invention relates to a method for the at least partial detachment or separation of a sealing film or foil that is sealingly attached to a rim of a neck of a container, vessel, bottle, or the like, which rim has a circular sealing surface and the neck has an male thread and a center axis, and a screw cap having a female thread complementary to the male thread and capable of being screwed down onto the male thread of the neck sealed in the aforementioned manner and the cap can be unscrewed at any later point in time, as desired.

The invention further relates to a screw cap for the implementation of this method.

If it is required to protect possibly sterile contents of, say, a bottle for a prolonged period of time from outside influences, for example from the penetration of microbes or other contaminants, it is still necessary, as in the prior art, to apply a sealing film that is impermeable to the aforementioned substances to the rim of the mouth of the bottle in such a way that the actual sealing surface also cannot be penetrated by these substances.

In general, aluminum foils that have a coating of, for example, HDPE (high duty polyethylene) or a similar material on their sealing side are used for standard plastics material bottles made of, for example, polyethylene (PE) or polyethylene terephthalate (PET). After such a sealing film is placed on the rim of the bottle, the coating of the sealing film is welded to the rim of the bottle. The sealing film then adheres firmly and forms an impervious seal with the rim. Gluing rather than welding is another option.

According to this prior art, a screw cap is screwed down to protect the sealing film, and the user then loosens or peels off this film by hand after unscrewing the screw cap and pulling off any originality seal ring that may be present, on the screw cap in order to allow access to the contents of the container. In particular when only part of the bottle's contents have been used, the bottle with its remaining contents can then be resealed by screwing the screw cap back on.

With every bottle containing, say, fresh milk or juice, the consumer finds it awkward not only to have to unscrew the screw cap, but also to have to grasp a piece of the sealing film projecting beyond the rim of the neck of the bottle and then to peel off the sealing film, an operation that requires a certain amount of dexterity.

SUMMARY OF INVENTION

The object forming the basis of the invention can thus be regarded as comprising the creation of a method, and also a screw cap for the implementation of said method, in which it is no longer necessary to grasp the sealing film and peel it off by hand once the screw cap has been unscrewed.

This object is achieved with a method defined above in a first embodiment of the invention, in which, when the screw cap is unscrewed from the bottle neck, the sealing film is at least partially detached from the rim of the neck, radially, starting from the periphery of the rim and progressing inwardly toward the center axis, to be ultimately lifted off from the rim.

If appropriate, means can be provided for storing the detached sealing film within the screw cap.

According to the invention, the process of unscrewing the screw cap thus includes the detachment of the sealing film from the rim of the container or the bottle and, if appropriate, subsequent storage of the sealing film in the screw cap, which cap can then be screwed onto, or unscrewed from, the neck in the usual manner a number of times, as required, until the contents of the container have been consumed due to removal thereof each time. Separate detachment of the sealing film by hand is thus no longer necessary.

Prior to the initial screwing of the screw cap onto the male thread of the neck, a reinforcement disk coated on one side with an adhesive can advantageously be inserted into the screw cap and, when the cap is subsequently screwed onto the neck, said disk will be pressed with its adhesive against the sealing film that is sealingly attached to the rim of the neck, in which case a surface-to-surface bonding of the reinforcement disk with the sealing film is achieved after the cap has been screwed down. Advantageous reinforcement of the generally rather thin and flexible sealing film is thus achieved, which in turn enables the screw top to grip the sealing film more easily.

Preference is given to the use of induction welding for surface-to-surface bonding of the reinforcement disk to the sealing film, a thermoplastic compound being used as adhesive.

Alternatively, reinforcement of the sealing film may be achieved by using a sealing film which has already been reinforced by a surface-to-surface bonded reinforcement disk, or a sealing film that has been stiffened or is resistant to bending.

Furthermore, a glue, lamination, or sealing wax composed of, say, PE, PET, polyester, or polystyrene, or a combination of these substances, may be used as an adhesive on that surface of the reinforcement disk which faces the sealing film.

A screw cap for the implementation of the method of the invention has a top section and also a sleeve section having a female thread and an open end to enable screwing of the cap onto, and unscrewing thereof from, a male thread of a neck having a rim of, say, a bottle, which is hermetically sealed by a sealing film having a radially overlapping circumferential zone and which is sealingly attached to a circular sealing surface of the rim of the neck, and which is capable of being detached and/or destroyed in order to expose the contents of the bottle.

According to the invention, the screw cap, and thus a first device solution according to the aforementioned object, is characterized by having at least one detachment knife disposed on the sleeve section between the female thread and the top section and along the inside periphery of, the sleeve section, which knife, in its starting position prior to screwing down the screw cap, extends obliquely toward the open end of the screw cap and inwardly toward the center axis of the neck or of the screw cap, wherein the distance of the detachment knife from the center axis prior to screwing down is less than the outside diameter of the rim of the neck, which detachment knife is resiliently displaced as the screw cap is screwed down onto the neck of the bottle, and, due to the pressure imposed by the rim of the neck and the circumferential zone of the sealing film, the detachment knife with its knife edge resiliently bends upwardly and comes to rest on the outer periphery of the neck above the male thread and beneath the radially overlapping circumferential zone of the sealing film, and is resiliently deformed and resiliently pre-stressed toward the center axis when the cap is screwed down, and is further characterized in that, when the cap is unscrewed, the knife edge of the detachment knife is disposed initially obliquely in relation to the sealing film and toward the center axis, and then, due to its resilience, continuously penetrates further radially inwardly toward the center axis between the overlapping circumferential zone of the sealing film and the rim of the neck of the bottle, wherein the sealing film is adapted to be progressively separated from the rim of the bottle toward the center axis and stored in the screw cap between the detachment knife and the top section.

As may be seen, the screw cap of the invention detaches the sealing film that has been sealingly attached to the exposed rim of the neck of the bottle or the like in that the detachment knife progressively penetrates inwardly between the rim of the neck of the bottle and the sealing film, if necessary to beyond the inside diameter of the neck, toward the center axis of the neck, and entrains the sealing film after detachment thereof, and the separated sealing film is held firmly between the detachment knife and the top section.

In a preferred embodiment, a plurality of individual detachment knives is fixed to the sleeve section and distributed around the inside periphery of the sleeve section in the circumferential or rotational direction, which knives, being disposed radially about the center axis in a common plane, leave a clearance in the zone of the center axis which has a smaller diameter than that of the annular region of the sealing film, or than the outside diameter of the rim of the neck of the bottle or the like. Depending on the properties of the adhesive used and thus on the strength of the bond, it may be sufficient if the detachment knife only partially severs the sealing film by its spiral cutting action, while the remainder of the film is simply removed or torn off on account of the tension exerted on the sealing surface of the sealing film when the circumferential zone of the sealing film is further raised as the cap is progressively unscrewed.

Each individual detachment knife advantageously has a knife edge that partially extends in the unscrewing direction and that in each case effects a spiral movement producing an inward incision at the sealing surface between the sealing film and the rim of the neck.

Each knife edge can advantageously be concavely curved and have a radially projecting, pointed cutting projection trailing in the rotational unscrewing direction, which favors penetration at the sealing surface.

It is particularly advantageous if at least one circular pressure lip is formed on the inside of the top section of the screw cap, disposed about the center axis opposite to the circumference of the sealing film with its reinforcement disk, if present, which lip presses the circumferential zone of the sealing film and the reinforcement disk, if present, onto the rim of the neck and nestles thereon as the screw cap is screwed down.

This deformation of the circumference of the sealing film on the one hand and the reinforcement disk, if present, on the other hand also favors the penetration of the detachment knife or knives into the space between the sealing film and the rim, because the circumference of the sealing film and the reinforcement disk, if present, forms a guide for the detachment knife or knives extending obliquely toward the sealing film and toward the center axis in such a way that the at least one detachment knife, as it slides in between the sealing film and the rim and assumes an increasingly horizontal detachment plane, and penetrates between the sealing film and the rim and, if necessary, into the free space in the clearance of the neck, can completely remove the sealing film. If the at least one detachment knife then becomes increasingly erect from the rim of the neck of the bottle or the like as the cap is progressively unscrewed, it can usually return to the position that it originally had prior to the cap being screwed down, namely extending obliquely toward the open end and toward the center of the cap.

If there is only one detachment knife, it can be configured to extend around the inside periphery of the sleeve section, in other words as an annular knife. The elasticity of the screw cap material provides the necessary deflectability of this annular knife toward the center axis.

However, it must be emphasized that the alignment of the at least one detachment knife described above such that it extends in its initial position obliquely toward the open end and inwardly toward the center axis, of the cap, is not obligatory. In fact, the alignment can alternatively be achieved by designing the knife shape, on the one hand, and connecting it to the sleeve section along the inside periphery thereof, on the other hand, such that the at least one detachment knife extends obliquely upwardly toward the top section and inwardly toward the center axis, of the screw cap. In this case the at least one detachment knife already has substantially the alignment required for the process of severing the sealing film from the neck.

Furthermore, the aforementioned object is also achieved with a method of the aforementioned type in a second embodiment of the invention, wherein an intermediate layer of a glue and/or sealing wax is introduced between the top section and the neck before the screw cap is screwed down onto the neck of the container or the like, the intermediate layer being pressed onto the sealing film by the inside surface of the top section as the screw cap is screwed down onto the neck of the container, and the inside surface is glued or welded to the surface of the sealing film in such a way that the sealing film firmly adheres to the inside surface and the sealing film is at least partially entrained by the screw cap when the latter is unscrewed from the neck of the container or the bottle.

This entrainment occurs in the rotational direction of the screw cap. The entrained section of the sealing film remains affixed to the inside surface of the top section.

When the screw cap has been unscrewed, the container is thus completely or at least partially opened so that the contents thereof can be removed.

The sealing film advantageously has, at least at certain points, embossments or perforations configured as breaking points in the circumferential direction within the clearance of the neck, and with the aid of the intermediate layer, the inside surface of the top section is only glued or welded to the surface of the sealing film in the region of the surface surrounded by the embossments or perforations.

This makes it possible to tear off a central zone of the sealing film in a controlled manner by unscrewing the screw cap.

A disk consisting of at least two layers is advantageously used as a sealing film, wherein the layer facing the inside surface of the top section can be composed substantially of PE, PET, or aluminum and the layer facing the neck can be composed substantially of PE, PET, or sealing wax, or a combination of the aforementioned substances.

The construction can be such that only the layer of the sealing film facing the inside surface of the top section is embossed or perforated, at least at certain points, within the clearance of the neck.

Preference is given to an embossment or perforation forming a complete circle.

A preferred screw cap for the implementation of the method of this second embodiment of the invention and thus a second device solution of the aforementioned object according to the invention, especially one of plastics material, comprises a top section and a sleeve section having a female thread and an open end for screwing onto, and unscrewing from, a male thread of a neck with a rim of a bottle or the like, which is hermetically sealed with a sealing film that is sealingly attached to a circular sealing surface of the rim of the neck, is characterized according to the invention in that the top section has an inverted, anvil-like, inner, plate-like projection facing its inside surface, so configured that the inside surface is capable of being reliably positioned on the surface of the sealing film when the screw cap is screwed down onto the neck of the container or the like.

The vessel, container, bottle, or the like used can be composed of glass or plastics material or the like.

Preferably, the sealing film, especially when made of aluminum and/or plastics material, has a circumferential zone radially overlapping the rim of the neck. The resulting circumferential zone forms an additional guide for the detachment knife or knives and forms, as it were, a barrier forbidding intrusion into the top space of the screw cap, particularly when the pressure lip, if present, is raised as the screw cap is unscrewed to progressively expose such a circumferential zone, against which it had formerly nestled, in such a way that the at least one detachment knife bearing against the circumferential zone is then guided below the circumferential zone toward the sealing surface.

Preferably, the screw cap of the invention is made of made of plastics material.

BRIEF DESCRIPTION OF THE DRAWING FIGURES

Embodiments of the invention are explained in greater detail below with reference to the preferred exemplary embodiments illustrated in the drawings, in which.

DETAILED DESCRIPTION OF EMBODIMENTS

Figure 1:
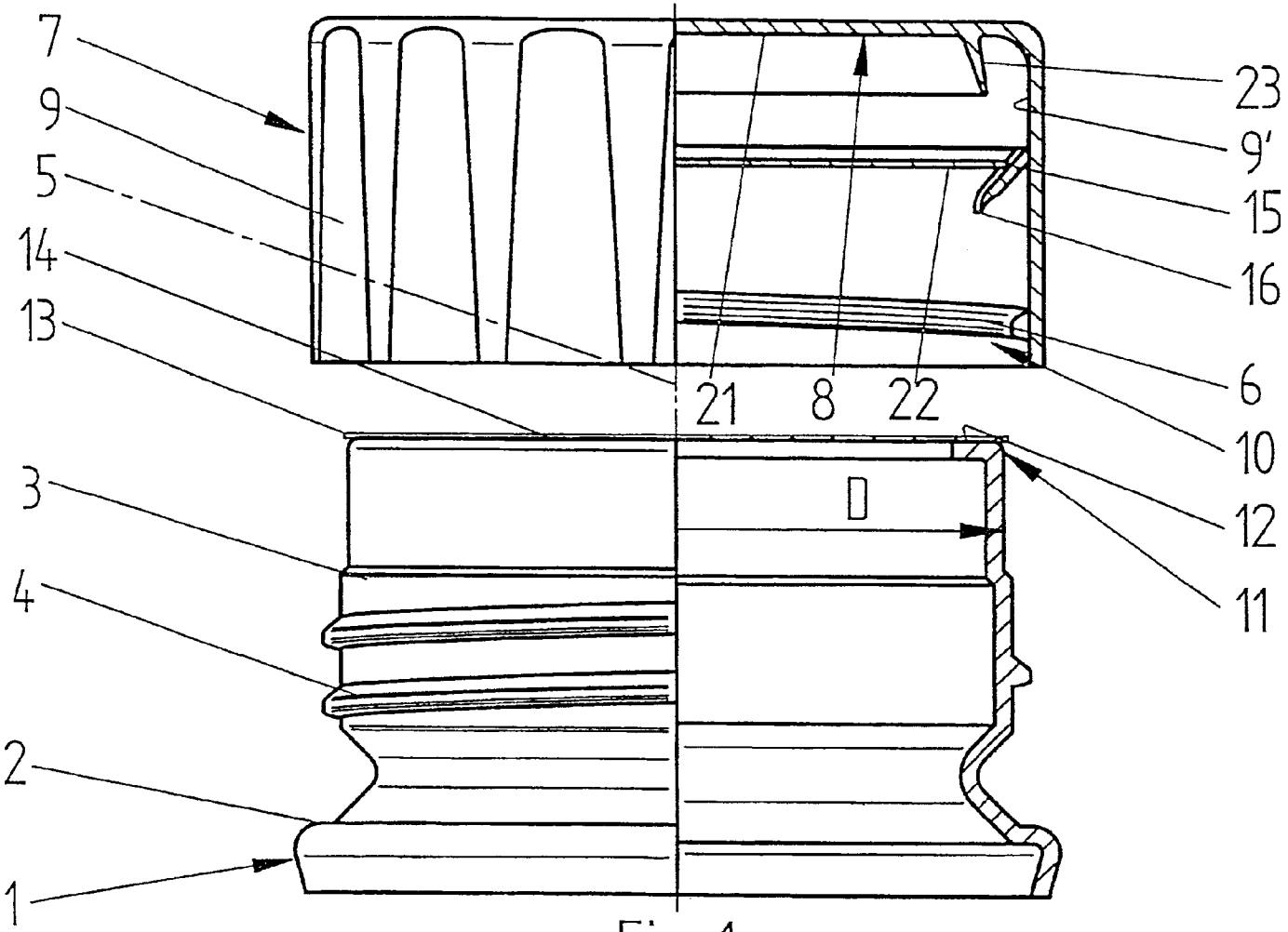
FIG. 1 shows a side view of a first embodiment of a screw cap of the invention prior to placement thereof on the neck of a bottle and prior to it being screwed down onto the neck, in a partially cutaway side view of the screw cap and of the neck.

The shoulder zone 2 of a bottle 1 with a neck 3 is shown in FIG. 1, which shoulder zone has a male thread 4 and a center axis 5. In addition, a screw cap 7 having a female thread 6 is shown, which screw cap, like the bottle, can be made, say, of a plastics material such as PE or PET. The screw cap 7 has a top section 8, and a sleeve section 9 that has a female thread 6 and a open end 10 so that it is capable of being screwed down onto, and unscrewed from, the male thread 4 on the neck 3 of the bottle 1, which neck has a rim 11.

The neck 3 is hermetically sealed by a sealing film 14 having a radially overlapping circumferential zone 13, which is sealingly attached to an annular sealing surface 12 (FIG. 10) of the rim 11 of the neck 3. The sealing film 14 is capable of being detached and/or destroyed in order to allow access to the respective contents of the bottle.

According to the invention, at least one detachment knife 15 is provided, which knife is disposed between the female thread 6 and the top section 8 at the inside periphery 9' of the sleeve section 9, and, in the starting position shown in FIG. 1, extends radially and obliquely toward the open end 10 and inwardly toward the center axis 5 and which has a knife edge 16 disposed at a distance from the center axis 5 of the neck 3 of the bottle 1 which is smaller than the outside diameter D of the rim 11 of the neck 3 before the cap is screwed down.

Figure 2:
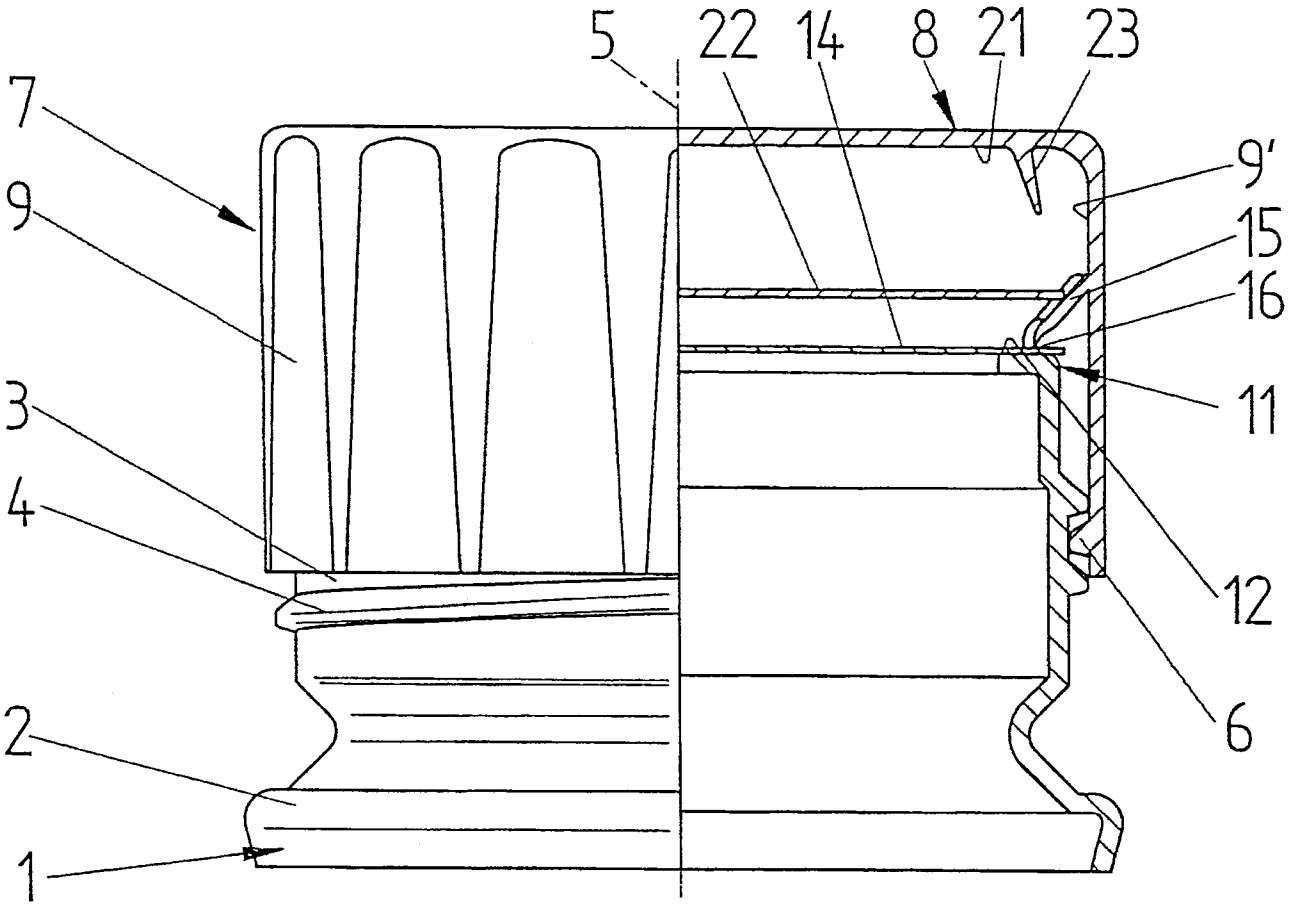
FIG. 2 shows a view according to FIG. 1 of a position after starting to screw the screw cap onto the neck of the bottle in which the knife edge of a detachment knife is just touching the surface of the sealing film on the rim of the neck.
Figure 3:
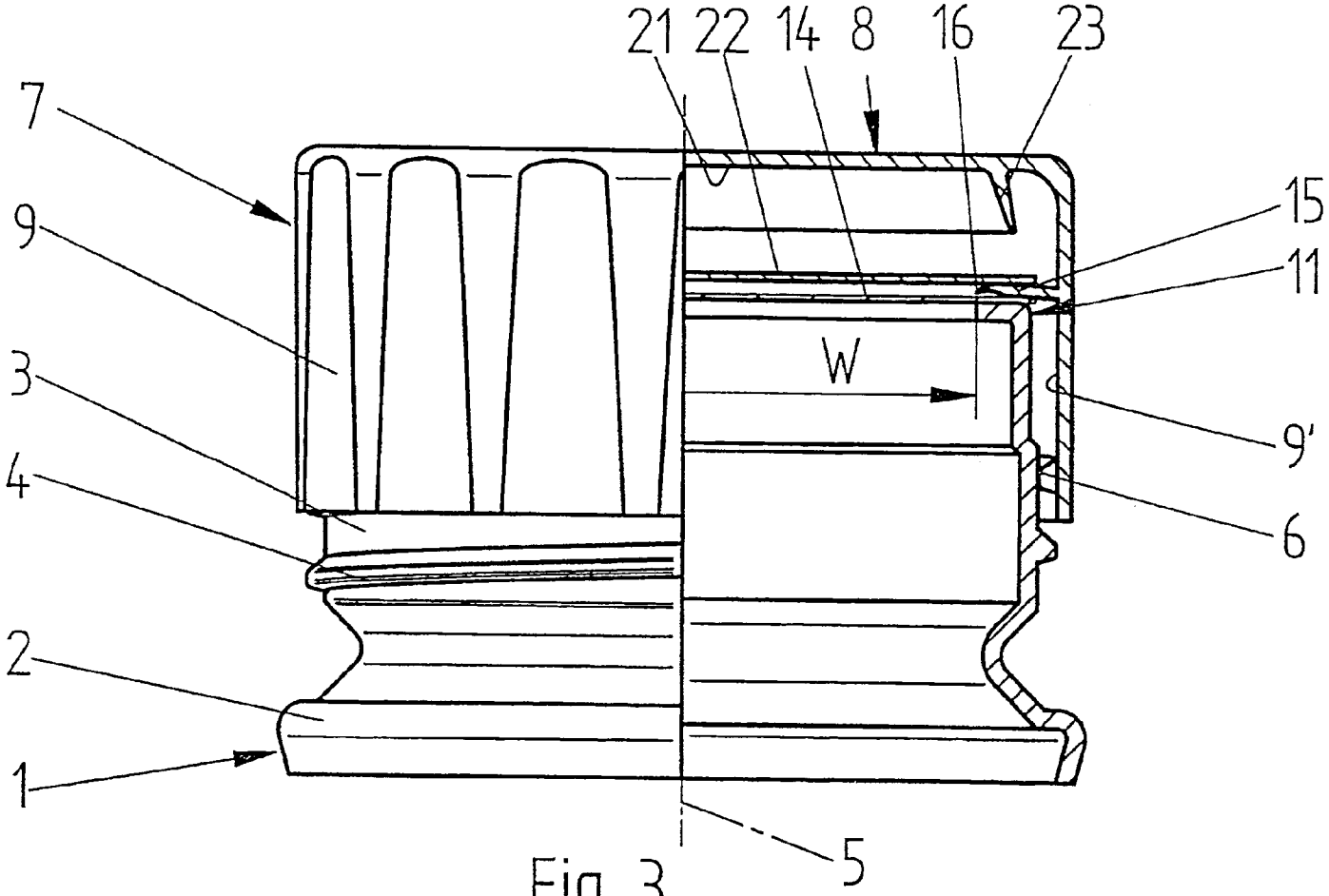
FIG. 3 shows the screw cap according to FIG. 2 in a middle screwed-down position, in which the detachment knife is resting in a substantially horizontal position on the sealing film.
Figure 4:
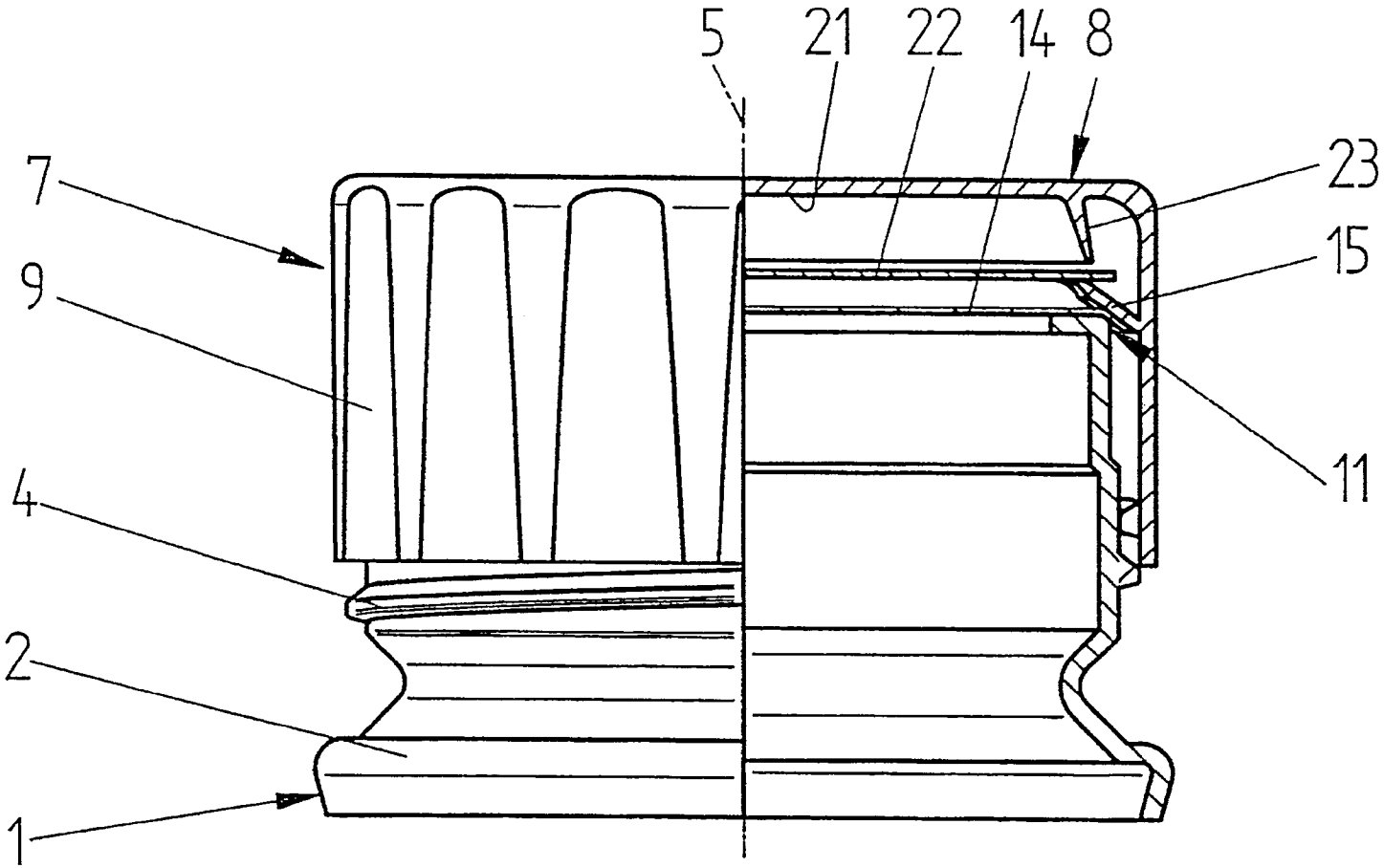
FIG. 4 shows the screw cap according to FIG. 3 screwed down beyond the middle position in which the detachment knife, however, is not yet completely bent upwards.

When the screw cap 7 is screwed down onto the neck 3 of the bottle 1, it will arrive at a position, as shown in FIG. 2, at which it is sufficiently screwed down onto the neck 3 for the knife edge 16 to touch the surface of the sealing film 14. As the cap is tightened, the detachment knife 15 will be elastically displaced in an upward direction, as shown in FIG. 3, in which the detachment knife 15 is shown as being in a substantially horizontal position. Further tightening of the screw cap causes the detachment knife 15, as in FIG. 4, to bend upwardly, and in the final, fully tightened position of the screw cap 7, the detachment knife 15 with its knife edge 16 will have moved resiliently to an oblique erect position as a consequence of the pressure exerted by the rim 11 of the neck 3 via the circumferential zone 13 of the sealing film 14. The detachment knife 15, resiliently deformed and under spring tension, comes into position on the outer periphery 17 of the bottleneck 3 above the male thread 4 and below the radially overlapping circumferential zone 13 of the sealing film 14. Its final position is also discernible in FIG. 5.

Figure 5:
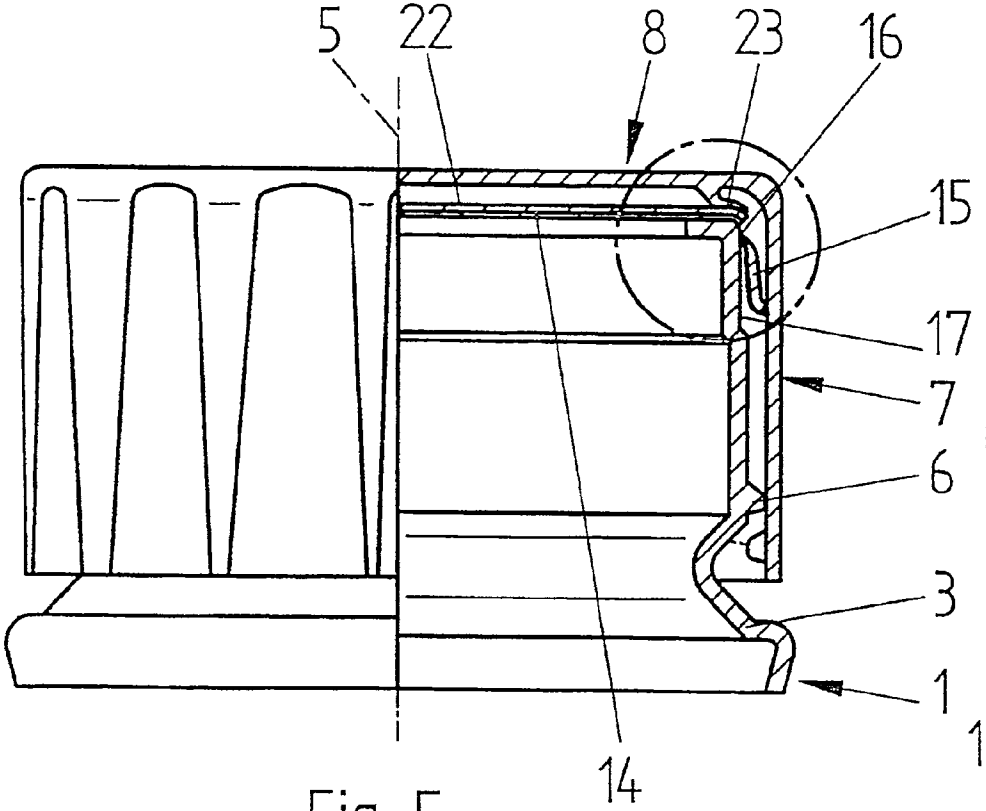
FIG. 5 shows the screw cap according to the previous figures in the final, fully tightened position, in which the detachment knife is also in a final, erect position and a pressure lip disposed on the inside of the top section of the screw cap has positioned itself on the sealing film under resilient deformation.
Figure 7:
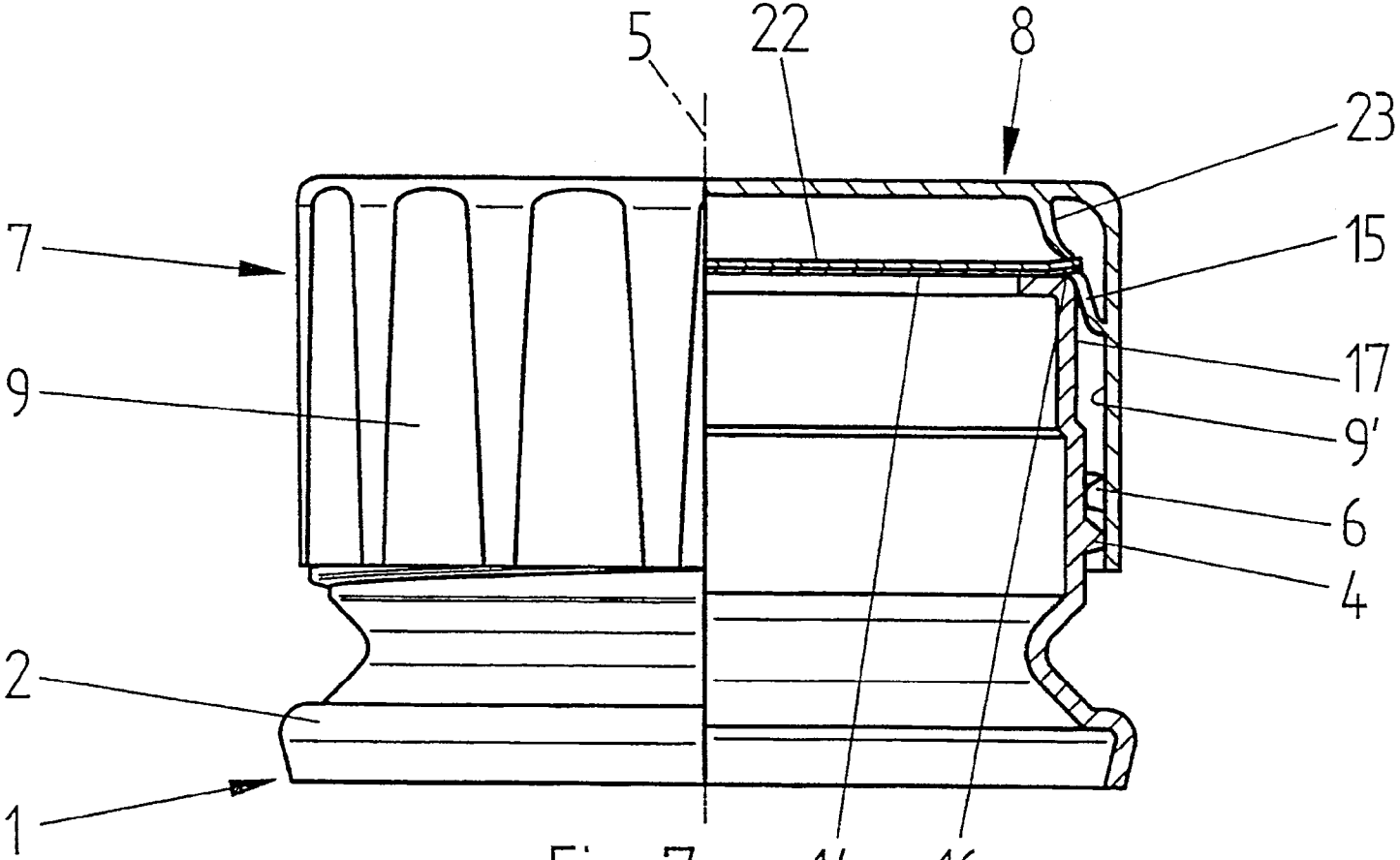
FIG. 7 shows the screw cap according to FIG. 5 after unscrewing has commenced, in a position at which the knife edge of the detachment knife has started to penetrate between the rim of the container and the sealing film.

This final position shown in FIG. 5 is such that, as the screw cap 7 is unscrewed, the sealing film 14 will be progressively detached and stored in the screw cap 7 between the detachment knife 15 and the top section 8 due to the action of the knife edge 16 of the detachment knife 15, which circumferentially penetrates between the overlapping circumference 13 of the sealing film 14 and the rim 11 of the neck 3 of the bottle 1, and initially extends obliquely toward the sealing film 14 and toward the center axis 5, and then, due to its continual springback action, penetrates more and more radially inwardly toward the center axis 5. The commencement of the action of the knife edges 16 on the sealing surface between the rim 11 or its sealing surface 12 and the sealing film 14 is shown in FIG. 7.

Figure 11:
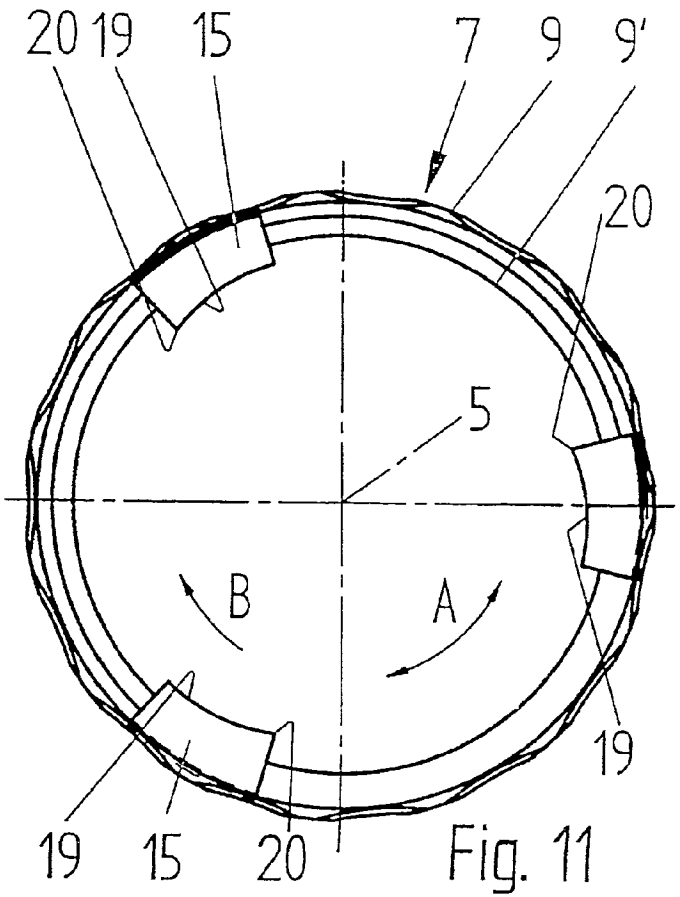
FIG. 11 is a bottom view of the screw cap in the direction X indicated by the arrow in FIG. 10.

In the preferred embodiment, as shown, there is, as illustrated in the bottom view shown in FIG. 11, a plurality of individual, single knives 15 distributed along the inside periphery 9' of the sleeve section 9 in the circumferential or screwing direction (double arrow A) and firmly attached to the sleeve section 9, which knives leave a clearance W in a two-dimensional radial position in a common plane in the zone of the center axis 5, as shown in FIG. 3, which clearance has the same diameter as, or a diameter smaller than that of, the circular sealing surface 12 of the rim 11 of the neck 3 of the bottle 1 or the like. In the exemplary embodiment shown, the clearance W of the single knives 15 is equal to the inside diameter of the rim 11 of the neck 3. Furthermore, three detachment knives are provided in this case.

It is unnecessary to emphasize that the invention is not limited to the three detachment knives 15 shown in FIG. 11, and that, in fact, the number of detachment knives 15 can be varied depending on the materials used for the sealing film 14 and its mode of attachment to the sealing surface 12 of the neck 3.

When there is only one detachment knife 15, it can be circumferentially configured around the inside periphery 9' of the sleeve section 9, i.e., as an annular knife (not shown), in which case the elasticity of the material of the screw cap 7 and that of the annular knife will provide the necessary deflectability of the latter toward the center axis 5.

Finally, concavely curved knife edges 19 have been employed in the embodiment shown in FIG. 11, which knife edges have a radially projecting, pointed cutting projection 20 that is trailed in the unscrewing, rotational direction B so that the knife edges 19 extend partially in the unscrewing direction A or have a component that points in the unscrewing direction A. This design would appear to be suitable for facilitating the transection of the sealing surface. There are other conceivable geometries of the detachment knives 15 that are suitable for achieving the object of the invention.

A pressure lip 23, circumferentially disposed about the center axis 5 and the sealing surface 12 and thus also disposed opposite to the sealing film 14, for which a reinforcement disk 22 is employed in this embodiment, is formed on the inside surface 21 of the top section 8 of the screw cap 7, which lip presses the circumferential zone 13 of the sealing film 14 and said reinforcement disk 22 against the rim 11 of the neck 3 such that it nestles against the rim.

Due to its length and its tendency to spring back to substantially its initial position as the screw cap 7 is unscrewed, the pressure lip 23 initially remains in partial contact with the upper surface of the sealing film 14 or the reinforcement disk 22 before it detaches itself completely from the sealing film 14 or the reinforcement disk 22 as the screw cap 7 is progressively unscrewed.

If it proves to be necessary from the start to reinforce the sealing film 14, due to the fact that the circumferential zone 13 is too flexible, in order to ensure optimal sliding of the individual knives 18 beneath the sealing film 14, a reinforcement disk 22 can also be attached flush with the upper surface of the sealing film 14 prior to sealing, for example, by welding with a thermoplastic compound or by gluing, in other words before the sealing film 14 is sealingly attached to the sealing surface 12 of the rim 11 of the neck 3 of the bottle 1.

Figure 12:
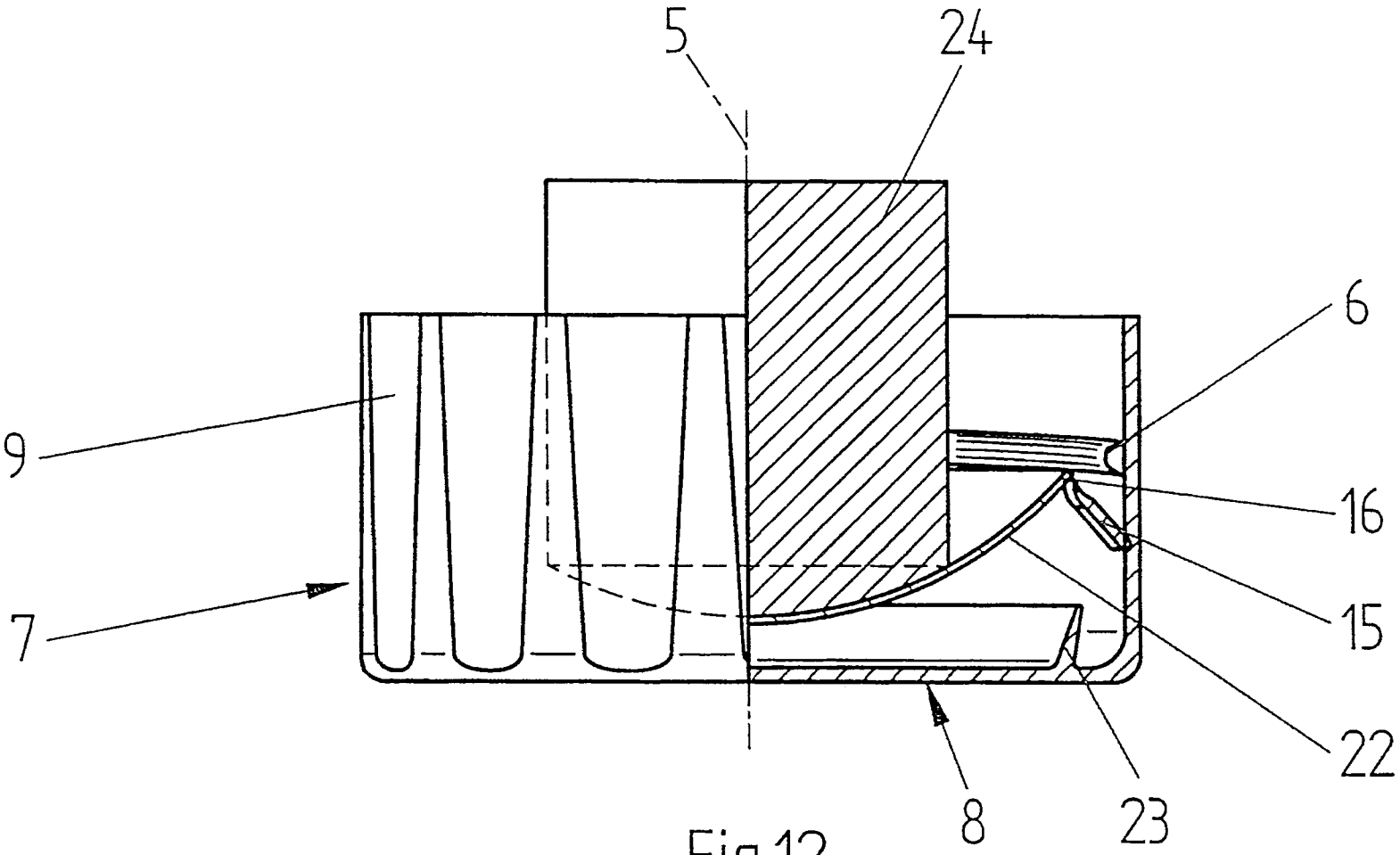
FIG. 12 shows a screw cap according to the previous figures, in which a reinforcement disk is being force fitted with a plunger.

In the present preferred embodiment shown in the figures, however, a reinforcement disk 22 is advantageously inserted in a screw cap according to FIG. 12 and pressed in place with a plunger 24 past the detachment knives 15 toward the top section 8. The screw cap 7, with the stiffening or reinforcing disk 22 held in place by the detachment knives 15, ultimately assumes the position shown in FIGS. 1 and 2.

Figure 10:
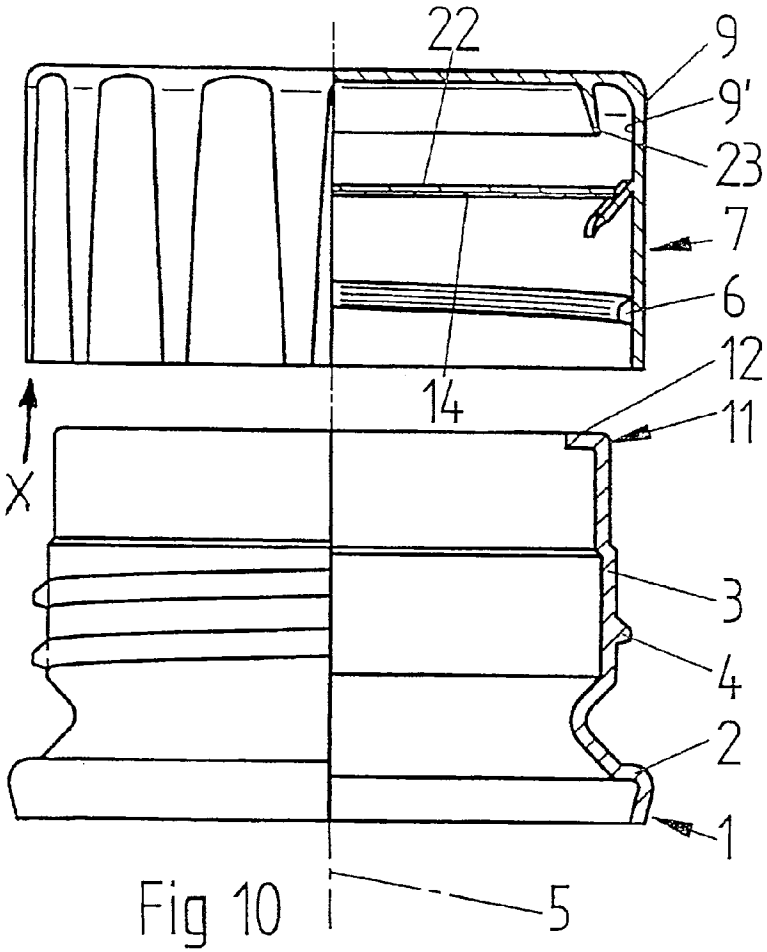
FIG. 10 shows the arrangement of the screw cap of the previous figures after removal thereof from the neck of the container, with the sealing film detached and retained in the screw cap by the detachment knife.

Unscrewing of the screw cap 7 of the present embodiment from the position shown in FIG. 5 or FIG. 6 to the position shown in FIG. 10 proceeds as follows:

Due to the action of the restoring forces of the three detachment knives 15, the knife edges 16 initially nudge into the region below the circumferential zone 13 of the sealing film 14 and thus raise the latter together with the edge of the superimposed reinforcement disk 22, as illustrated in FIG. 7.

On the one hand, this process is facilitated in the preferred embodiment shown in that a concave fillet 25 (FIG. 6) designed to fit around the rounded edge of the rim 11 of the neck 3 is provided on that side of the erect detachment knives 15 which face the neck 3, while on the other hand those regions of the detachment knives 15 near to the knife edges 16 are rounded on the side remote from the neck 3. In other words, the zones of the detachment knives adjacent to the knife edges 16 are always curved, thus favoring the penetration of the knife edges 16.

During this process, the pressure lip 23, which initially exerted pressure against the entire zone 26 indicated by dots (FIG. 6), partially lifts from the surface of the edge of the sealing film 14, i.e., in the case illustrated here, outwardly from the edge of the reinforcement disk 22.

Figure 6:
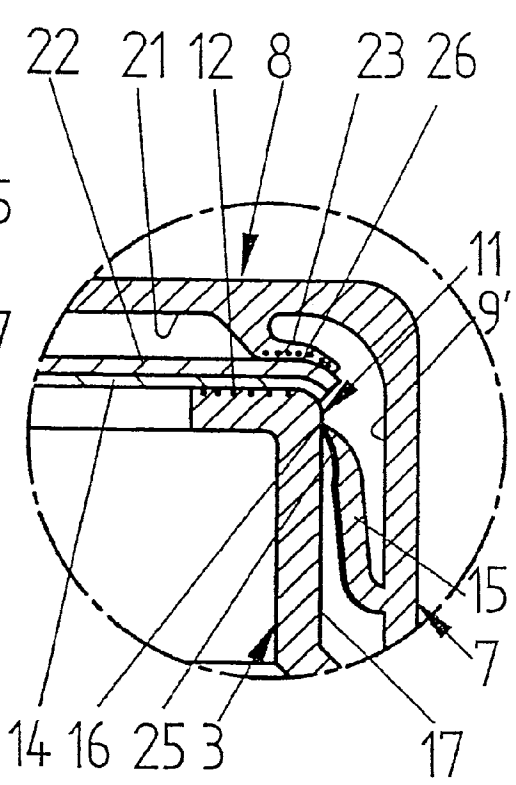
FIG. 6 shows a detail of FIG. 5 on an enlarged scale.
Figure 8:
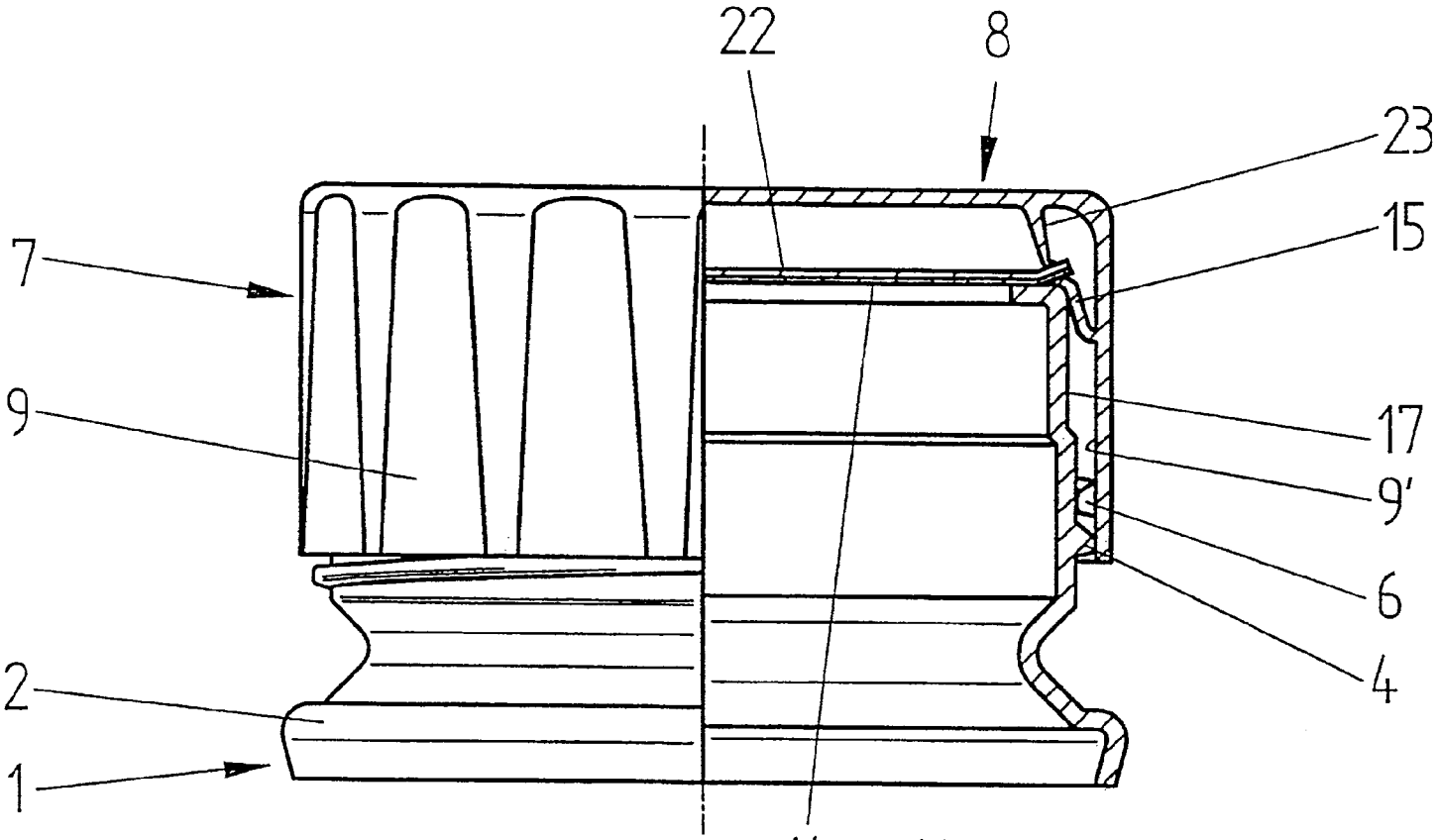
FIG. 8 shows the screw cap according to FIG. 7 after further unscrewing, in a position in which the detachment knife has already partially penetrated the sealing surface.

As the cap is unscrewed further, the knife edges 16, due to the elastic bending of the knife edges 16, penetrate into the region of the sealing surface 12 which is also indicated by dots in FIG. 6, cf FIG. 8.

Figure 9:
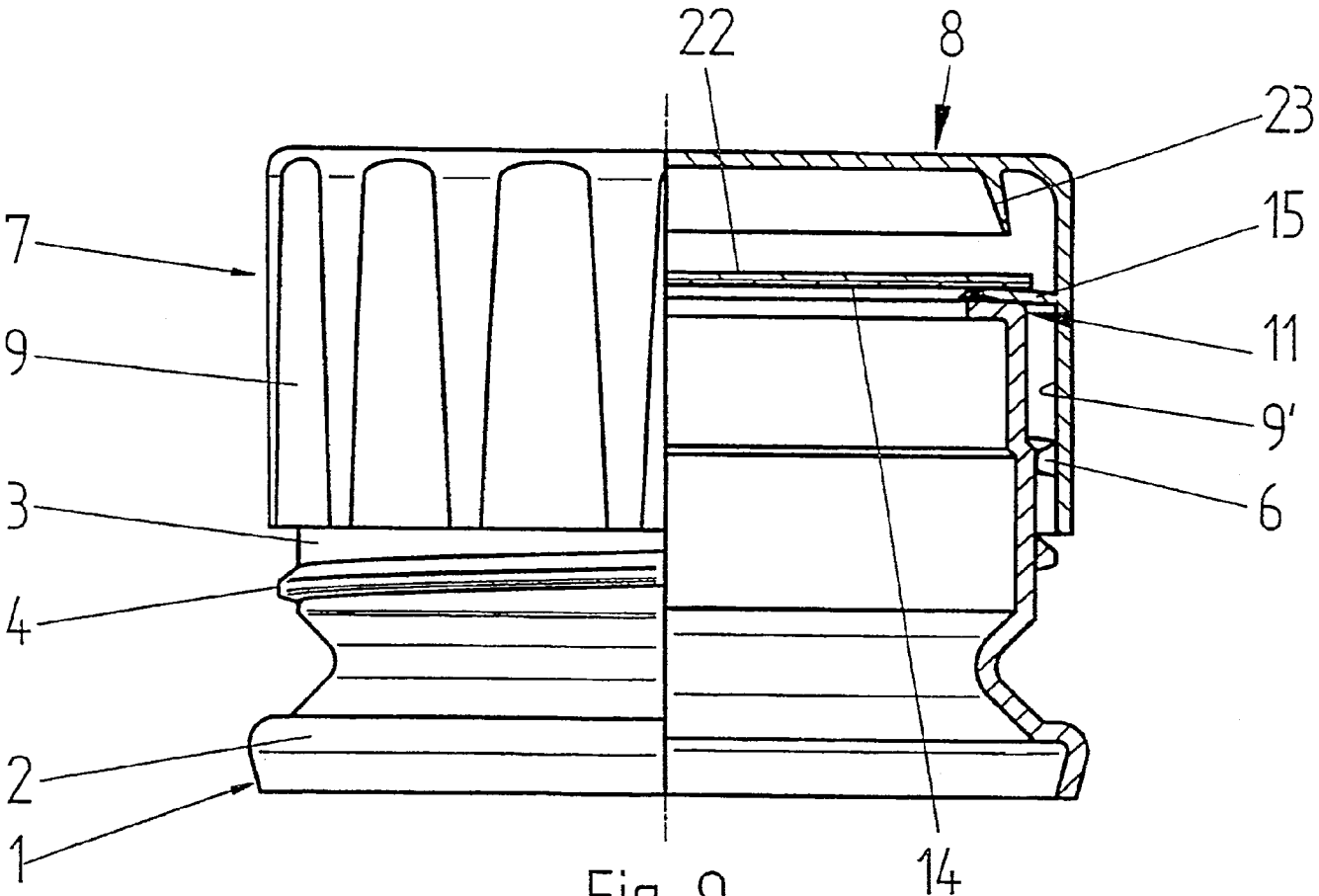
FIG. 9 shows the screw cap according to the previous figures after further unscrewing, in a position in which the detachment knife is in a substantially horizontal position and has already detached the sealing film.

In the illustrated embodiment, the detachment knives 15, when the position shown in FIG. 9 has been attained, have pushed their way along the entire sealing surface 12 and have completely detached the sealing film 14 with the reinforcement disk 22. Because the detachment knives 15 have a tendency to spring back to their initial positions occupied on the neck 3 prior to screwing down the screw cap 7, the situation illustrated in FIG. 10 with the detached sealing film 14 plus the reinforcement disk 22 within the removed screw cap 7 is achieved.

Figure 13:
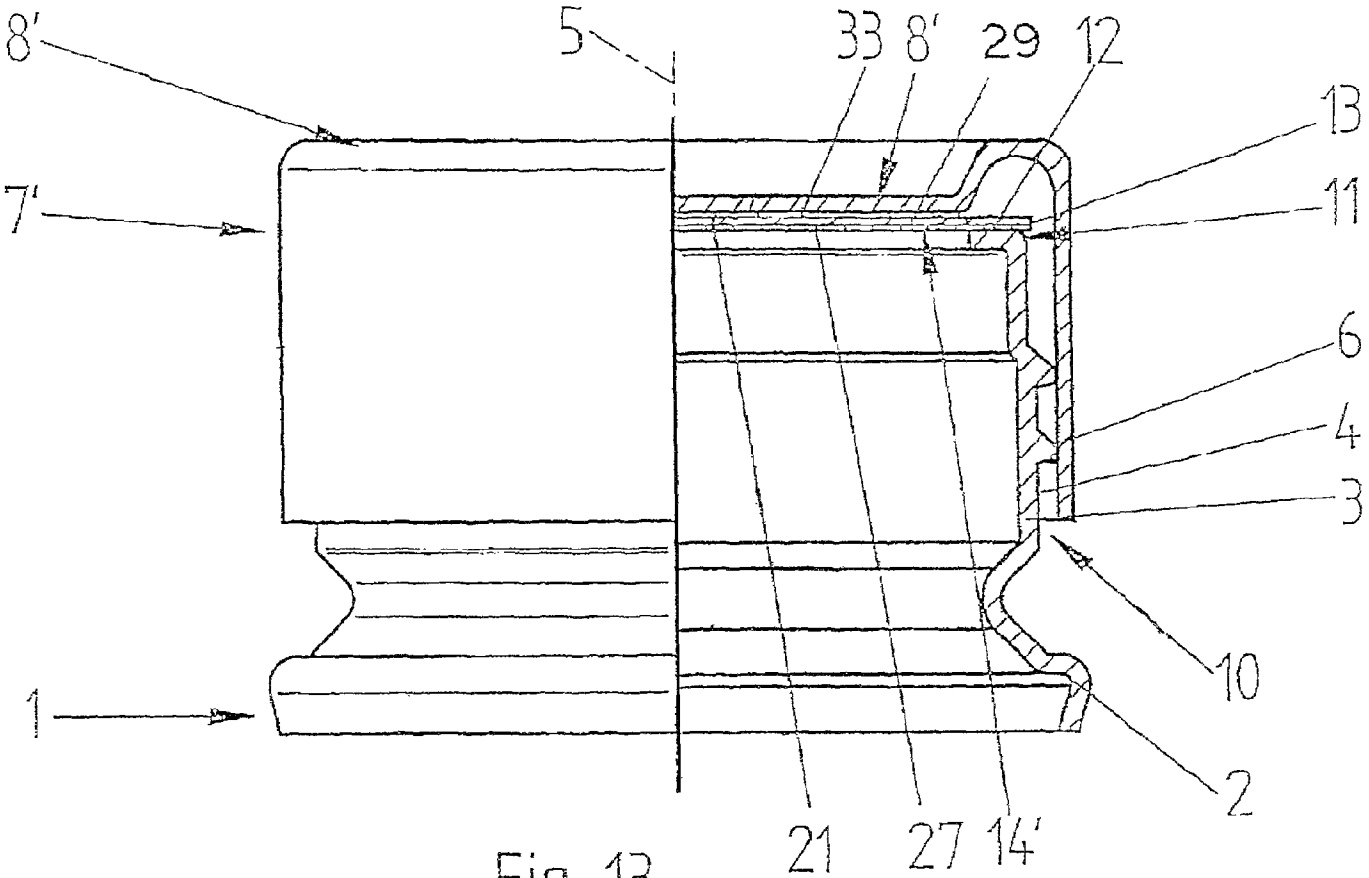
FIG. 13 shows a second embodiment of the invention with a modified screw cap in a side view corresponding to FIG. 1.
Figure 14:
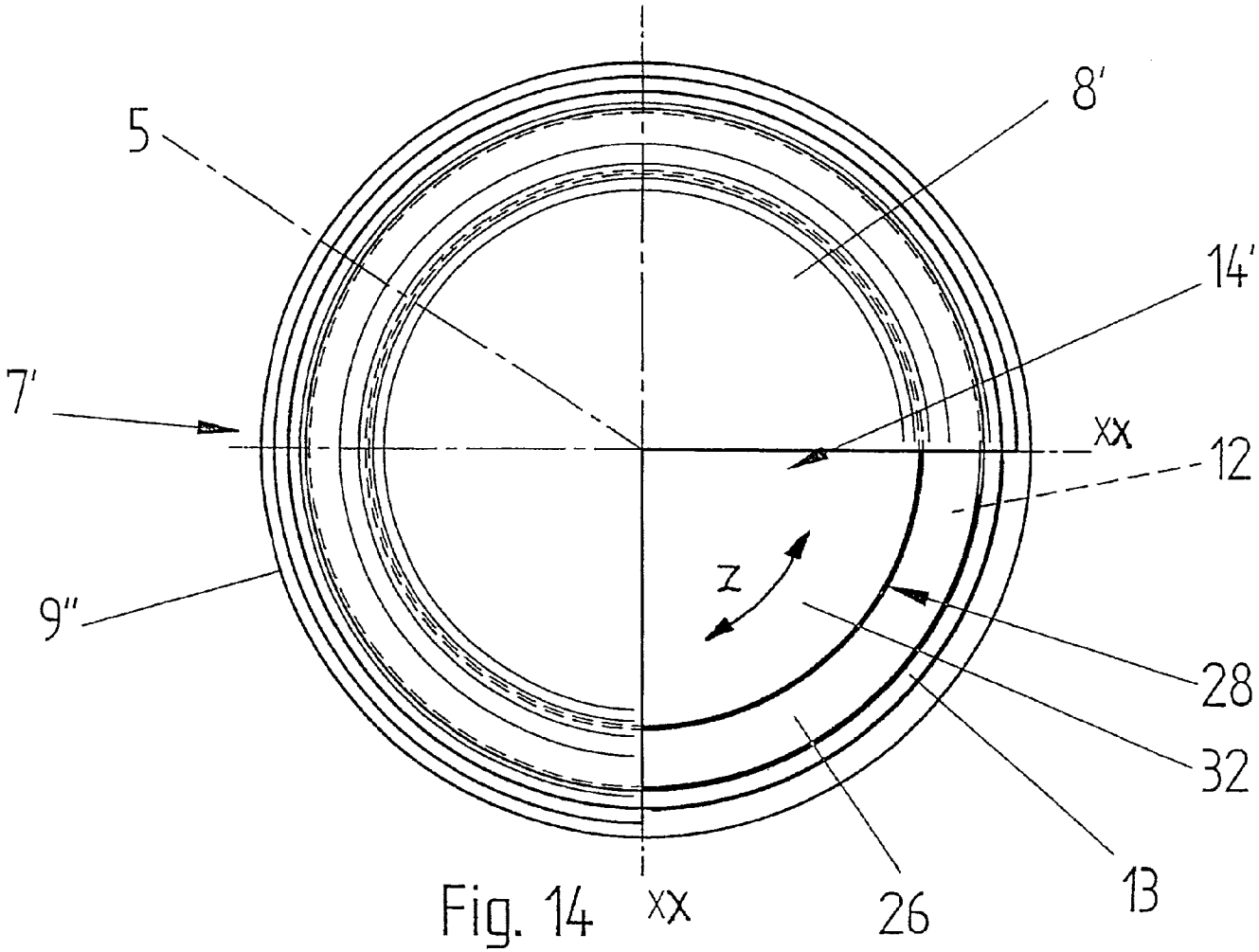
FIG. 14 is a top view of the screw cap according to FIG. 13, partially cut away along the line XX-XX.
Figure 15:
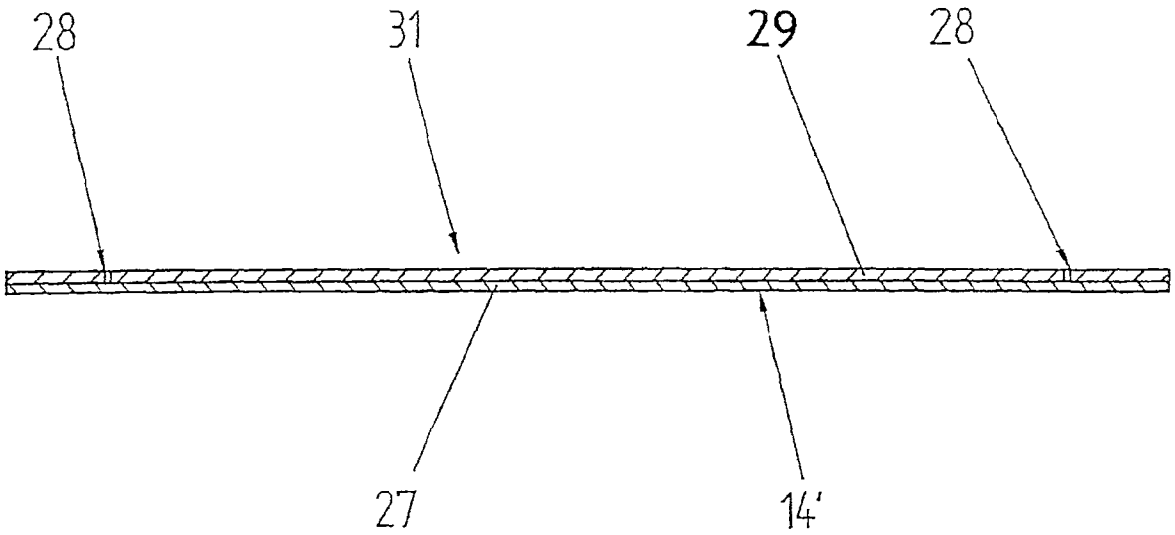
FIG. 15 is a sectional drawing of the sealing film according to FIGS. 13 and 14.

A second embodiment of the invention is illustrated in FIGS. 13 to 15. The parts corresponding to those of the first embodiment are designated by the same reference numerals.

This embodiment also relates to a method for the at least partial removal or detachment of a sealing film or foil 14', in particular a film or foil composed of aluminum and/or plastics material, sealingly attached to a rim 11 of a neck 3 of a container, especially a bottle 1 or similar container made of plastics material, glass, or the like, wherein the rim 11 has a circular sealing surface 12, the neck 3 has a male thread 4 and a center axis 5, and wherein a screw cap (7') having a female thread (6) complementary to the male thread (4) is screwed down onto the male thread (4) on the neck (3) sealed in the aforementioned manner, the cap being unscrewed at a later date as required.

According to the invention, an intermediate layer 33 consisting of a thermoplastic compound, a glue, and/or a sealing wax is introduced between the top section 8' or the inner surface 21 thereof and the sealing film 14' prior to screwing down the screw cap 7' onto the neck 3 of the container or the bottle 1. As the screw cap 7' is screwed down onto the neck 3 of the container 1, the intermediate layer 33 is pressed onto the sealing film 14' by the inner surface 21 of the top section 8' and the inner surface 21 is then welded or glued to the surface of the sealing film 14' in such a way that the sealing film 14' adheres tightly to the inner surface 21 and, as a consequence of such adhesion, the sealing film 14' is at least partially entrained by the screw cap 7' when the screw cap 7' is unscrewed from the neck 3 of the container or bottle 1.

A sealing film 14' having embossments or perforations configured as breaking points disposed at least at certain points in a circumferential direction within the clearance W of the neck 3 is advantageously used, the inner surface 21 of the top section 8' only being glued or welded to the surface of the sealing film 14' in the region of the surface 32 surrounded by the embossments or perforations 28.

The embossments or perforations considerably reduce the effort needed to tear the sealing film 14' when unscrewing the screw cap 7'.

A disk 31 (FIG. 15) is used as a sealing film 14' in this exemplary embodiment, the disk being constructed of two layers 29 and 27. The layer 29 facing the inner surface 21 of the top section 8' can be composed of PE, PET, or aluminum and the layer 27 facing the neck 3 can be composed of PE, PET, or sealing wax.

Preferably, the layer 29 of the sealing film 14' that faces the top section 8' is embossed or perforated at its circumference (double arrow Z, FIG. 14), at least at certain points, within the clearance W (FIG. 3) of the neck 3.

Furthermore, the perforations (28) (FIG. 15) in the preferred exemplary embodiment illustrated follows a circular line 28' (FIG. 14) around the circumference.

In a screw cap 7' for the implementation of the method described according to this second embodiment, which is also especially one composed of plastics material, there is a top section 8' and a sleeve section 9', the sleeve section having a female thread 6 and an open end 10 for screwing onto, and unscrewing from, a male thread 4 of a neck 3 of a bottle 1 or similar container composed of plastics material, glass or the like, the neck 3 having a rim 11, which is hermetically sealed with a sealing film 14' sealingly attached to a circular sealing surface 12 of the rim 11 of the neck 3 of the container 1, which sealing film is capable of being detached or destroyed to allow access to the contents of the bottle, and the top section 8' of the invention has an inverted, anvil-like, inner, plate-like projection 32 (FIG. 14) that extends toward the inner surface 21 and is configured in such a way that the intermediate layer 33 can be pressed into position on the surface of the sealing film 14' when the screw cap 7' is screwed down onto the neck 3 of the container 1 or similar vessel.

In this manner, optimal gluing or welding and thus a corresponding optimal adhesion of the top section 8' to the sealing film 14' and reliable entrainment of the latter is achieved when the screw cap 7' is unscrewed.

In general it has been shown to be advantageous to dimension the thread pitch and the thread mating 4, 6 in such a way that each 360.degree. turn of the screw cap 7, 70 raises the screw cap 7, 70 approximately 9 mm from the neck 3.

In order to achieve this, the female thread 6 can be configured as a triple thread.

Figure 16:
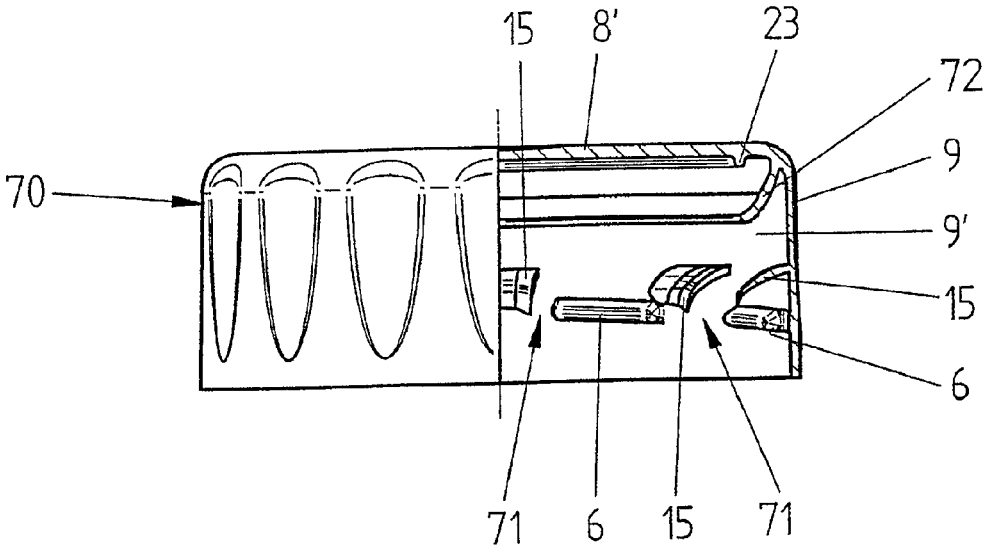
FIG. 16 is a longitudinal section of another embodiment of the screw cap of the invention in which the turns of the female thread have gaps in the region of the detachment knives for the accommodation of the detachment knives during the demolding process.

FIG. 16 shows another embodiment of the invention involving a screw cap 70.

In principle, it is advantageous if the degree of lift between the screw cap 7, 70 and the neck 3 given by the thread pitch and the mating of a male thread 4 with a female thread 6 used is, in the fully screwed position of the screw cap 7, 70 on the container 1, at least equal to the length of the detachment knife or knives 15, this length in turn being at least equal to the radial distance between the inside periphery 9' of the sleeve section 9, from which the detachment knife 15 projects outwardly, and an imaginary circle on the sealing surface 12 between the sealing film 14 and the rim 11.

Preferably, the circumference of the imaginary circle is formed by the inside periphery of the rim 11 of the neck 3 in such a way that the at least one detachment knife 15 always completely detaches the sealing surface 12. However, this is in no way obligatory. In fact, it may also be sufficient not to detach the sealing surface 12 completely, i.e., not to let the knife edge(s) 19 penetrate so far, but only as far as the imaginary circle in the zone of the sealing surface 12 on the rim 11 of the neck 3, and complete detachment of the sealing film 14, 14' occurs as a result of the latter being peeled off by the action of unscrewing the screw cap 7 with the at least one detachment knife 15 then lying under the edge of the sealing film 14'.

According to a preferred embodiment of the screw cap 70, the at least one detachment knife 15 is disposed on the inside periphery 9' of the sleeve section 9 above the female thread 6 and remote from the top section 8, and the thread path of the female thread 6 has gaps 71, the width u of which is substantially equal to, or slightly greater than, the width of the detachment knife 15 or detachment knives in the circumferential direction of the inside periphery 9', so that when the screw cap 70 is removed from the mold (not shown), the at least one detachment knife 15 can be pressed downwardly into the gaps 71 and remain briefly therein until they emerge from the mold and are exposed.

This design involving the gaps 71 permits considerable shortening of the height of the screw cap 70 and consequently a saving of plastics construction material, because the detachment knives 15 can be disposed in greater proximity to the female thread 6, which simultaneously avoids problems concerning the removal of the screw cap 70 from the mold in which it was injection-molded, especially in the case of the preferred use of plastics materials. Without the gaps 71, the height of a screw cap would inevitably have to be greater, because the detachment knives 15 inevitably bend downwardly when the cap is removed from the mold, and without the gaps the only place where the detachment knives could be accommodated would be in the space above the threads.

Furthermore, it is preferable that the detachment knife 15 or each of the detachment knives used always has a free end provided with a knife edge, which end is curved or bent toward the rim 11 when the sealing surface 12 is penetrated between the sealing film 14 and the rim 11 (this can be discerned particularly clearly from FIGS. 3 and 6). This favors the penetration of the knife edge(s) 19 between the sealing film 14 and the rim 11, not only when the sealing film 14, which in particular is advantageously composed of aluminum and/or plastics material, has a circumferential zone 13 radially overlapping the rim 11 of the neck 3.

Preference is given to an embodiment in which the free end of the at least one detachment knife 15 is also curved on both sides in such a way that it has a spoon-like, concave curvature (not shown) facing the rim 11.

It has been shown that such a shape makes the detachment knife ends particularly effective in detaching the sealing film 14, because the ends are resiliently flattened as they penetrate the sealing surface 12 and, due to their inherent restoring forces, they exert, in addition to the existing wedge effect, an upward and downward separating force normal to their surface, which force acts, on the one hand, on the sealing film 14 and, on the other hand, on the rim 11.

Finally, the screw cap 70 can also have a counter-pressure lip 72 (FIG. 16) in the form of an annulus disposed on the inside of the top section 8 between at least one concentrically disposed, in this case relatively short, i.e., low-height, pressure lip 23 and the inside surface 9' of the sleeve section 9, which counter-pressure lip presses against the sealing film 14 when the screw cap is screwed down onto the neck 3, and which, when the screw cap is unscrewed, is designed to support the edge of the sealing film 14 against the pressure of the ends of the detachment knife or knives 15 with its restoring force in such a way that said ends are more able to slide under the circumferential zone 13 of the sealing film 14 and penetrate the sealing surface 12.

It must be emphasized that the circumferential zone 13 does not necessarily have to overlap the rim 11 of the neck 3. It also does not necessarily have to have an unglued or unsealed circumferential edge in order to ensure optimal penetration by the knife edge(s) 19 of the detachment knife/knives 15.

The respective design of the embodiment of the invention is in this regard dependent on the parameters specified in each case, of which mention may be made of the material of the screw cap itself, the material of the sealing film 14, the material of the adhesive used, and the elasticity of the detachment knife/knives by way of example only. In the case of the screw cap 70, for example, no reinforcement disk 22 is used for a sealing film 14, although the film may require such reinforcement, as described in previous embodiments, which is why the counter-pressure lip 72 is advantageous in this embodiment.

In conclusion, it should be mentioned that the pressure lip 23, whether in the embodiments according to FIGS. 1 to 10 or in the embodiment according to FIG. 16, serves not only to exert pressure on a circumferential zone 13 of the sealing film 14, should such a circumferential zone be present, but also to reseal the neck 3 of, say, a bottle 1 after the sealing film 14 has been removed and when the bottle is reclosed each time the screw cap 7, 7', or 70 is unscrewed for the removal of part of the contents, by which means the bottle is resealed.

What is claimed is:

1. A method for making a cap to engage a neck of a container having a rim with a circular sealing surface, the neck having a male thread and a center axis, and a sealing film or foil that is sealingly attached to the rim, and the cap having a female thread complementary to said male thread for screwing down onto the neck for unscrewing at any later point in time, as desired, the method comprising the steps of configuring the cap including forming a detachment knife on the cap aligned from the periphery of the rim and progressing inwardly toward the center axis; and biasing said detachment knife radially to at least partially unseal the film or foil from said rim, and lifting said seal off from said rim, when said cap is unscrewed from said neck.

2. A method as defined in claim 1, and comprising:

prior to the initial screwing of the screw cap onto the male thread of the neck, installing a reinforcement disk, coating one side facing the neck with an adhesive, said disk will be for pressing with its adhesive against the sealing film that is sealingly attached to the rim of the neck when the cap is subsequently screwed onto the neck, to form a surface-to-surface bonding of the reinforcement disk with the sealing film after the cap has been screwed down.

3. A method as defined in claim 2, comprising induction welding the reinforcement disk to the sealing film, a thermoplastic compound being used as adhesive.

4. A method as defined in claim 2, and comprising reinforcing the sealing film on the neck before installing into the screw cap by a surface-to-surface bonded reinforcement disk, or a sealing film that has been stiffened or is resistant to bending.

5. A method as defined in claim 2, comprising using a glue, lamination, or sealing wax composed of substantially PE, PET, polyester, or polystyrene, or a combination of these substances, as an adhesive on the surface of said reinforcement disk facing the sealing film.

6. A screw cap having a top section, a sleeve section having a female thread, and an open end, that enable screwing of the cap onto, and unscrewing from, a container neck having a rim and a male thread, which neck is hermetically sealed by a sealing film which has a radially overlapping circumferential zone engaging the rim and which is sealingly attached to a circular sealing surface of the rim of the neck, and which is detached and/or destroyed in order to expose the contents of a bottle; the cap comprising:

at least one detachment knife disposed on the sleeve section between the female thread and the top section and extending along an inside periphery of the sleeve section in its starting position prior to being screwed down, the at least one detachment knife having a knife edge extending obliquely toward the open end of the screw cap and inwardly toward the center axis of the neck and the screw cap, wherein the distance of the detachment knife edge from the center axis prior to screwing down is less than an outside diameter (D) of the rim of the neck, the at least one detachment knife being resiliently displaced as the screw cap is screwed down onto the neck of the container, and, due to the pressure imposed by the rim of the neck and the circumferential zone of the sealing film, the detachment knife resiliently bends the knife edge upwardly and comes to rest on an outer periphery of the neck above the male thread and beneath the radially-overlapping circumferential zone of the sealing film, and the at least one detachment knife being resiliently deformed and resiliently prestressed toward the center axis once the cap is screwed down, and wherein when the cap is unscrewed, the knife edge of the detachment knife is disposed initially obliquely in relation to the sealing film and toward the center axis, and then, due to its resiliency by springing back, continuously penetrates further radially inwardly toward the center axis between the overlapping circumferential zone of the sealing film and the rim of the neck of the bottle, wherein the sealing film is engaged by the knife edge to be progressively separated from the rim of the bottle toward the center axis and to be stored in the screw cap between the detachment knife and the top section.

7. A screw cap as defined in claim 6 wherein said at least one detachment knife comprises a plurality of individual detachment knives fixed to the sleeve section and distributed around the inside periphery of the sleeve section in a circumferential direction (A), the knives being disposed radially about the center axis in a common plane to leave a clearance (W) in a zone of the center axis which has a smaller diameter than that of the circular sealing surface of the rim of the neck of the container.

8. A screw cap as defined in claim 6 and comprising each knife edge partially extends in the circumferential unscrewing direction (A).

9. A screw cap as defined in claim 8 and comprising each knife edge is concavely curved and has a radially projecting, pointed cutting projection trailing in the circumferential, unscrewing direction (A).

10. A screw cap as defined in claim 6 and comprising at least one circular pressure lip formed on an inside surface of the top section of the screw cap, disposed about the center axis opposite to the circumferential zone of the sealing film to press the circumferential zone of the sealing film onto the rim of the neck and nestles thereon as the screw cap is screwed down.

11. A screw cap as defined in claim 6, and comprising the at least one detachment knife configured to extend around the inside periphery of the sleeve section in the form of an annular knife.

12. A method for making a cap for the neck of a container, a rim of the neck having a sealing film on the rim surface and the neck having a male thread and a center axis, and the cap having a female thread complementary to the male thread and capable of being screwed down onto the male thread of the neck and unscrewed at any later point in time, the method comprising:

providing a detacher before the screw cap is screwed down onto the neck of the container, for unsealing at least part of the film or foil from said rim;

installing an intermediate layer for being pressed onto the sealing film by an inside surface of a top section of the cap as the screw cap is screwed down onto the neck of the container, adhering said intermediate layer to the inside surface; and adhering by gluing or welding to a surface of the sealing film in such a way that the sealing film firmly adheres to the inside surface for at least partially detaching the sealing film by the intermediate layer adhered in the screw cap when the cap is unscrewed from the neck of the container.

13. A method as defined in claim 12 and comprising forming points, embossments or perforations configured as breaking points in the sealing film in a circumferential direction within a clearance of the neck, and the adhering the intermediate layer to the inside surface of the top section in a region of the surface surrounded by said embossments or perforations.

14. A method as defined in claim 13, wherein said installing an intermediate layer comprises installing a disk consisting of at least two layers as the sealing film, wherein the layer facing the inside surface of the top section is composed substantially of PE, PET, or aluminum and the layer facing the neck is composed substantially of PE, PET, or sealing wax, or a combination of the aforementioned substances.

15. A method as defined in 13, comprising adhering only the intermediate layer to the sealing film facing the inside surface of the top section within embossment or perforations within the clearance of the neck.

16. A method as defined in claim 13 wherein said forming comprises shaping points, an embossment or perforation as a complete circle.

17. A screw cap for a container having a neck with a male thread, and a sealing film that is sealingly attached to a circular sealing surface of a rim of the neck, the cap having a top section and a sleeve section having a female thread corresponding to the male thread and an open end for screwing onto, and unscrewing from, the neck, the cap comprising:

means for removing at least a portion of the sealing film having a detacher in the form of an inverted, anvil-like, inner, plate-like projection facing an inside surface of the top;

an intermediate layer under the anvil-like projection;

a first adherent to engage the inside surface; and having a second adherent to bear against the surface of the sealing film when the screw cap is screwed down.

18. A screw cap as defined in claim 17, comprising the container being composed of plastics material or glass or the like.

19. A screw cap as defined in claim 17, comprising the sealing film is made of aluminum and/or plastics material.

20. A screw cap as defined in claim 17 comprising the cap being composed of plastics material.

21. A screw cap as defined in claim 6 comprising the sleeve section having a degree of lift between the screw cap and the neck given a thread pitch of the male thread and the female thread from the fully screwed-down position of the screw cap on the container, is at least equal to the detachment knife having a length at least equal to the radial distance between the inside periphery of the sleeve section and an inside periphery of the rim.

22. A screw cap as defined in claim 21, comprising the detachment knife length being greater than the radial distance between the circular sealing surface of the rim of the neck and the inside periphery of the sleeve section.

23. A screw cap as defined in claim 21 comprising the thread pitch and the thread mating are dimensioned in such a way that each 360° turn of the screw cap raises the screw cap approximately 9 mm from the neck.

24. A screw cap as defined in claim 21 comprising the female thread is configured as a triple thread.

25. A screw cap as defined in claim 21 comprising the at least one detachment knife being disposed on the inside periphery of the sleeve section above the female thread toward the top section, and the thread path of the female thread has gaps, the width of the gap being substantially equal to, or slightly greater than, the width of each at least one detachment knife in the circumferential direction of the inside periphery, wherein when the screw cap is removed upwardly from a mold, the at least one detachment knife can be pressed downwardly into the gaps and remain briefly therein until they emerge from the mold and are exposed.

26. A screw cap as defined in claim 21 comprising the at least one detachment knife having a free end provided with a knife edge, the free end being curved or bent toward the rim when the circular sealing is penetrated between the sealing film and the rim.

27. A screw cap as defined in claim 26, comprising the free end of the at least one detachment knife being curved on both sides in such a way that it has a spoon-like, concave curvature.

28. A screw cap as defined in claim 27 comprising a counter-pressure lip in the form of an annulus is provided on the inside of the top section between at least one concentrically disposed pressure lip and the inside surface of the sleeve section.

* * * * *